US008847473B2

(12) United States Patent
Ye

(10) Patent No.: US 8,847,473 B2
(45) Date of Patent: Sep. 30, 2014

(54) SELF-COOLING SCREW BULB-TYPE ELECTROMAGNETIC INDUCTION LAMP

(76) Inventor: Lianying Ye, Guangdong (CN)

( * ) Notice: Subject to any disclaimer, the term of this patent is extended or adjusted under 35 U.S.C. 154(b) by 107 days.

(21) Appl. No.: 13/599,252

(22) Filed: Aug. 30, 2012

(65) Prior Publication Data

US 2013/0057136 A1 Mar. 7, 2013

(30) Foreign Application Priority Data

| | | |
|---|---|---|
| Sep. 1, 2011 | (CN) | 2011 2 0325129 U |
| Dec. 1, 2011 | (CN) | 2011 2 0494266 U |
| Jun. 25, 2012 | (CN) | 2012 2 0300963 U |

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01J 1/58*** | (2006.01) |
| ***H01J 1/50*** | (2006.01) |
| ***H01J 65/04*** | (2006.01) |

(52) U.S. Cl.

CPC ..... *H01J 61/523* (2013.01); *H01J 65/048* (2013.01); *H01J 65/044* (2013.01); *H01J 65/04* (2013.01)

USPC ..... 313/45; 313/161

(58) Field of Classification Search

CPC ..... H01J 61/106; H01J 61/523; H01J 61/52

USPC ..... 313/45, 161

See application file for complete search history.

(56) References Cited

U.S. PATENT DOCUMENTS 6,433,478 B1 * 8/2002 Chandler et al. ..... 313/607

* cited by examiner

*Primary Examiner* — Anh Mai
*Assistant Examiner* — Zachary J Snyder
(74) *Attorney, Agent, or Firm* — Jackson IPG PLLC

(57) ABSTRACT

A self-cooling screw bulb-type electromagnetic induction lamp comprises a bulb body, an inner tube, amalgam and a coupler, wherein the inner tube is arranged inside the bulb body, and the coupler is arranged inside the inner tube; besides, the lamp further comprises a screw-type lamp cap and a radiating piece, wherein the bulb body is connected on the screw-type lamp cap through the radiating piece, and the coupler is connected with the radiating piece. The disclosure effectively solves the problem that the installation of the electromagnetic induction lamp is incompatible with the conventional lighting fitting, while effectively improving the heat-radiating efficiency and the performances, thereby facilitating the promotion, popularization, application and development of the electromagnetic induction lamp.

7 Claims, 2 Drawing Sheets

SELF-COOLING SCREW BULB-TYPE ELECTROMAGNETIC INDUCTION LAMP

TECHNICAL FIELD OF THE INVENTION

The disclosure relates to the technical field of illuminating electric appliances, and in particular to a bulb-type electromagnetic induction lamp.

BACKGROUND OF THE INVENTION

Electromagnetic induction lamp is a new type light source and has been used for commercial illumination only in recent decades, thus, the application time is relatively short and the electromagnetic induction lamp still has technical defects as follows.

1. The luminous principle of the electromagnetic induction lamp is that atoms are excited to generate ultraviolet by electromagnetic induction and then fluorescent powder is excited to illuminate by the ultraviolet; however, the heat generated when a magnetic material of a coupler of a bulb works has a great impact on the performance of the magnetic material, thus it is necessary to consider the heat-radiating problem of the magnetic material when designing the electromagnetic induction lamp. Therefore, the bulb-type electromagnetic induction lamp in the conventional art generally fixes a heat-conducting device of a magnetron on a lighting fitting through a screw so as to dissipate heat through the lighting fitting or a radiating head; however, this makes installation very inconvenient. In addition, since the coupler is installed on the lighting fitting, it is needed to demount the entire lighting fitting before replacing the coupler; therefore, great inconvenience is caused to maintenance.

2. The lighting fitting is a carrier of the lamp; the light source in the conventional art mostly adopts a screw-type or bayonet-type lamp cap to connect to a lamp base all the time, so lighting fittings are designed according to the screw-type or bayonet-type lamp cap. If the electromagnetic induction lamp is to be installed, the lighting fitting needs to be modified, thus the product cost is increased undoubtedly and a lot of inconvenience is caused. During the process of reforming an old illuminating system, the lighting fitting needs to be replaced too, thus not only a great waste of resources is caused, but the electromagnetic induction lamp can not be well popularized and applied.

3. Transport is inconvenient. Since the installation of the existing structure is complex, it is inconvenient to assemble on site; therefore, a lamp generally is installed in a lighting fitting when the product leaves factory; however, the lighting fitting can not be overlapped, the transport space occupied is relatively large and damage is easily caused during the transport process.

4. The coupler would generate a large quantity of heat when the electromagnetic induction lamp works, and the highest temperature reaches over 270° C.; however, the main amalgam realizes the best working state by adjusting temperature and the working temperature generally is between 40° C. and 130° C.; if the temperature is too high, the working difficulty of the main amalgam would be increased and a great impact is caused to the photoelectric parameter of the lamp; consequently, the luminous efficiency and the power are reduced, and the difficulty of producing a high-power bulb-type electromagnetic induction lamp is increased; at present, it is difficult to produce a bulb-type electromagnetic induction lamp of over 250 W.

5. In the conventional art, in order to increase the power of the bulb-type electromagnetic induction lamp, generally, the bulb body is manufactured bigger, or the diameter of a heat-conducting part of the coupler is increased, or the heat is exported by a double-end head-conducting rod; in this way, great inconvenience is caused to the design, production and use undoubtedly.

SUMMARY OF THE INVENTION

The disclosure aims at overcoming the defects in the conventional art and providing a self-cooling screw bulb-type electromagnetic induction lamp, which solves the problem that the installation of the electromagnetic induction lamp is incompatible with the conventional lighting fitting, while effectively improving the heat-radiating efficiency and the performances, and thus facilitates the application and development of the bulb-type electromagnetic induction lamp.

The purpose of the disclosure is realized by the technical scheme as follows.

The disclosure provides a self-cooling screw bulb-type electromagnetic induction lamp, which comprises: a bulb body, an inner tube, amalgam and a coupler, wherein the inner tube is arranged inside the bulb body, and the coupler is arranged inside the inner tube; besides, the lamp further comprises a screw-type lamp cap and a radiating piece, wherein the bulb body is connected on the screw-type lamp cap through the radiating piece, and the coupler is connected with the radiating piece. The electromagnetic induction lamp of the disclosure dissipates the heat of the coupler through the radiating piece and introduces a conventional screw-type lamp cap, so that the electromagnetic induction lamp can be compatible with the conventional lighting fittings; thus, the installation process of the lighting fitting is simplified, the original lighting fitting can be kept during the installation process, the waste of resources and cost caused by the replacement of the lighting fitting is reduced, moreover, the heat-radiating effect is good; therefore, it is easy to prompt, popularize and apply the electromagnetic induction lamp.

The disclosure can adopt the following measures: the radiating piece includes a heat-conducting piece, a metal lamp cap cover and more radiating fins, wherein the heat-conducting piece is arranged below the metal lamp cap cover and is connected with the coupler; the radiating fins is arranged in order on the outer wall of the metal lamp cap cover; and the bulb body is connected on the screw-type lamp cap through the metal lamp cap cover and the heat-conducting piece. The heat of the coupler is dissipated by being conducted to the metal lamp cap cover through the heat-conducting piece and then being radiated through the radiating fin on the metal lamp cap cover.

Further, the amalgam is arranged at the bottom of the bulb body and inside the metal lamp cap cover. A radiating window is arranged on the position of the metal lamp cap cover corresponding to the amalgam to facilitate the heat radiation of the surrounding of the amalgam, thus the problem that the amalgam is greatly influenced by temperature in a small space is solved, the working temperature at the amalgam position is effectively reduced, and the requirement for the amalgam is reduced too, that is, the amalgam without a very high working temperature can be selected to meet the power requirement and the start performance of the lamp can be improved.

In an implementation scheme, the disclosure also comprises a radiating plate which is connected on the lower plane of the heat-conducting piece, so that the heat of the coupler conducted through the heat-conducting piece also can be dissipated in a mode of radiation and convection through the radiating plate, moreover, the heat can be further taken away in a mode of metal heat-conduction through the contact between the radiating plate and the metal lamp cover, thus the heat-radiating speed of the coupler is accelerated, the working temperature of the coupler is greatly reduced, the power of the electromagnetic induction lamp can be made greater, and the power of the electromagnetic induction lamp with a screw-type lamp cap can rise to 150 W and 200 W.

In another implementation scheme, a through hole interconnected with the inner tube is arranged on the bulb body, and the lower end of the inner tube is interconnected with the radiating window; further, the through hole is located at the top end of the inner tube and the top of the bulb body. In this way, two ends of the inner tube inside the bulb body are interconnected to form air convection; when the bulb works, the heat generated in the middle part of the coupler flows out from the radiating window to form a low pressure zone, which drives the cold air at the top of the bulb near the through hole to infuse into the inner tube and then to exude from the lower end of the inner tube and flow out from the radiating window, to form convection of cold and hot air; thus the heat-radiating speed of the coupler is accelerated, the working temperature of the coupler is greatly reduced and the power of electromagnetic induction lamp can be made greater.

In the latter implementation scheme, the radiating plate can be added on the lower plane of the heat-conducting piece to further dissipate the heat.

In the implementation schemes above, the radiating plate is in a gear shape and each tooth is in a long strip shape, so that a relatively long gap is kept between adjacent teeth, the fluidity of the heat is enhanced and the heat can be dissipated in time; thus the heat-radiating effect is further improved. Further, the radiating plate is in a bent shape and the edge is bent towards the bulb body, so as to increase the contact area between the radiating plate and the metal lamp cover. For the metal lamp cover with different radians, the bending angle of the long-strip tooth of the radiating plate can be slightly adjusted to well contact the metal lamp cover.

The heat-conducting and heat-radiating measures adopted in the disclosure are applicable to a bulb-type low-frequency electromagnetic induction lamp (with working frequency of about 250 KHz) and a bulb-type high-frequency electromagnetic induction lamp (with working frequency of about 2.5 MHz). For the bulb-type low-frequency electromagnetic induction lamp, since there is no positive electrode and negative electrode, the screw-type lamp cap of the disclosure is connected to a power supply of the electromagnetic induction lamp through an electrode lead welding spot on a metal screw-type lamp cap and an electrode lead welding spot on an electrode contact.

In the electromagnetic induction lamp of the disclosure, a ceramic transition piece is arranged between the radiating piece and the screw-type lamp cap, thereby avoiding the problem of poor heat resistance of the conventional plastic piece.

BRIEF DESCRIPTION OF THE DRAWINGS

The disclosure is described below in further detail in conjunction with embodiments and accompanying drawings.

DETAILED DESCRIPTION OF THE EMBODIMENTS

Embodiment 1

Figure 1:
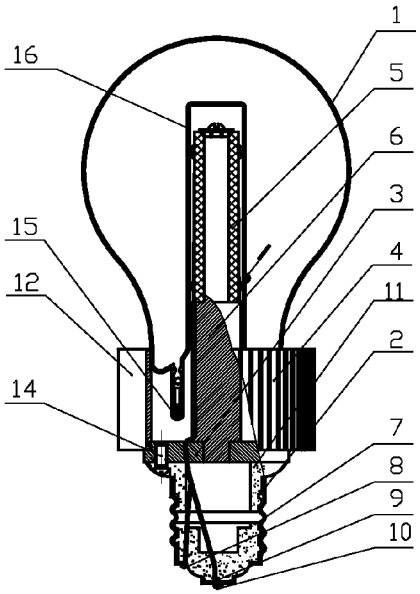
FIG. 1 shows a structure diagram of an Embodiment 1 of the disclosure.

FIG. 1 shows an Embodiment 1 of a self-cooling screw bulb-type electromagnetic induction lamp of the disclosure, which comprises a bulb body 1, an inner tube 16, a coupler, a screw-type lamp cap 2 and a radiating piece, wherein the inner tube 16 is arranged inside the bulb body 1, and the coupler is arranged inside the inner tube 16.

As shown in FIG. 1, the radiating piece comprises a heat-conducting piece 3, a metal lamp cap cover 4 and more radiating fins 12, wherein the heat-conducting piece 3 is arranged below the metal lamp cap cover 4; the radiating fins 12 is arranged in order on the outer wall of the metal lamp cap cover 4; the bulb body 1 is connected on the screw-type lamp cap 2 through the metal lamp cap cover 4 and the heat-conducting piece 3; and the heat-conducting piece 3 is fixed on the screw-type lamp cap 2 through the screw 14.

As shown in FIG. 1, the coupler consists of a magnetic rod 5 and a heat-conducting metal bar 6, wherein the bottom of the heat-conducting metal bar 6 is integrated with the heat-conducting piece 3. The heat of the coupler is dissipated by being conducted to the heat-conducting metal bar 6 through the magnetic rod 5, to the heat-conducting piece 3 through the heat-conducting metal bar 6 and to the metal lamp cap cover 4 through the heat-conducting piece 3, then the heat is dissipated by the radiating fin 12 on the metal lamp cap cover 4.

Amalgam 15 is arranged at the bottom of the bulb body 1 and inside the metal lamp cap cover 4.

For a bulb-type low-frequency electromagnetic induction lamp, the screw-type lamp cap 2 realizes the connection between a bulb lead and two power supply terminals on a screw-type lamp base through an electrode lead welding spot 8 on a metal screw-type lamp cap 7 and an electrode lead welding spot 10 on an electrode contact 9. A ceramic transition piece 11 is arranged between the radiating piece 3 and the screw-type lamp cap 2.

Embodiment 2

Figure 2:
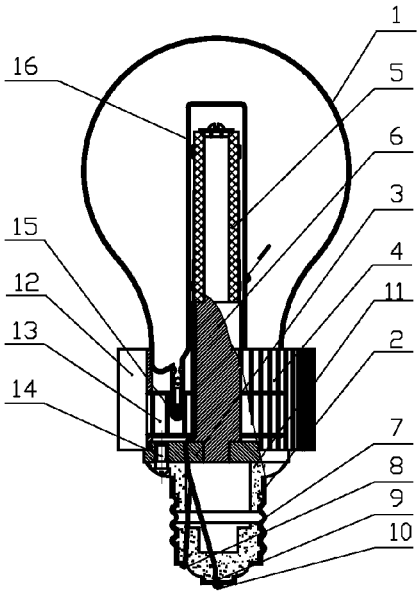
FIG. 2 shows a structure diagram of an Embodiment 2 of the disclosure.

FIG. 2 shows an Embodiment 2 of a self-cooling screw bulb-type electromagnetic induction lamp of the disclosure. In this embodiment, based on the Embodiment 1, a radiating window 13 is arranged on the position of the metal lamp cap cover 4 corresponding to the amalgam 15 (see FIG. 2), for facilitating the dissipation of the heat of the coupler, so that the temperature at the surrounding of the amalgam 15 can be effectively controlled.

Embodiment 3

Figure 3:
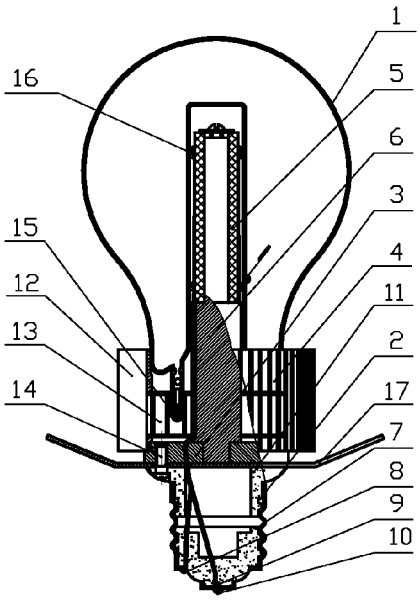
FIG. 3 shows a structure diagram of an Embodiment 3 of the disclosure.
Figure 4:
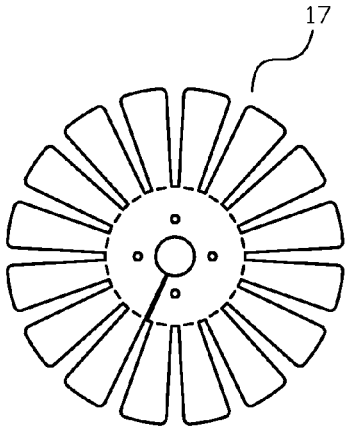
FIG. 4 shows a structure diagram of a radiating plate in the embodiment shown in FIG. 3.

FIG. 3 and FIG. 4 show an Embodiment 3 of a self-cooling screw bulb-type electromagnetic induction lamp of the disclosure. In this embodiment, based on the Embodiment 2, a radiating plate 17 is arranged on the lower plane of the heat-conducting piece 3 (see FIG. 3), wherein the heat-conducting piece 3 and the radiating plate 17 are fixed on the screw-type lamp cap 2 through the screw 14. Besides, the ceramic transition piece 11 is arranged between the radiating plate 17 and the screw-type lamp cap 2.

As shown in FIG. 4, the radiating plate 17 is in a gear shape and each tooth is in a long strip shape, so that a relatively long gap is kept between adjacent teeth. Moreover, the radiating plate 17 is in a bent shape and the edge is bent towards the bulb body 1 (see FIG. 3), so as to increase the contact area between the radiating plate 17 and the metal lamp cover.

While the heat of the coupler is conducted to the metal lamp cap cover 4 through the heat-conducting piece 3, the heat is further conducted to the radiating plate 17 and then is taken away in a mode of metal heat-conduction mode through the contact between the radiating plate 17 and the metal lamp cover, thus the heat-radiating effect is obviously improved and the power of the lamp can be made greater.

Embodiment 4

Figure 5:
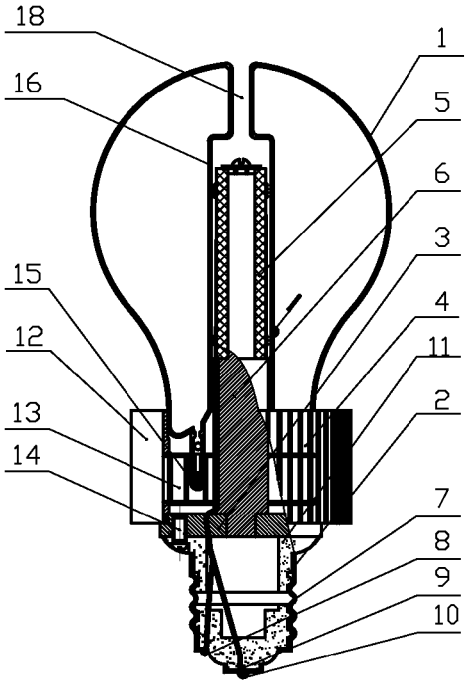
FIG. 5 shows a structure diagram of an Embodiment 4 of the disclosure.

FIG. 5 shows an Embodiment 4 of a self-cooling screw bulb-type electromagnetic induction lamp of the disclosure. In this embodiment, based on the Embodiment 2, a through hole 18 interconnected with the inner tube 16 is arranged on the top of the bulb body 1 and on the top end of the inner tube 16 (see FIG. 5), and the lower end of the inner tube 16 is interconnected with the radiating window 13, so that two ends of the inner tube 16 are interconnected to form air convection, thus, the heat-radiating speed of the coupler is accelerated, the working temperature of the coupler is greatly reduced, and the power of the electromagnetic induction lamp can be made greater.

Embodiment 5

Figure 6:
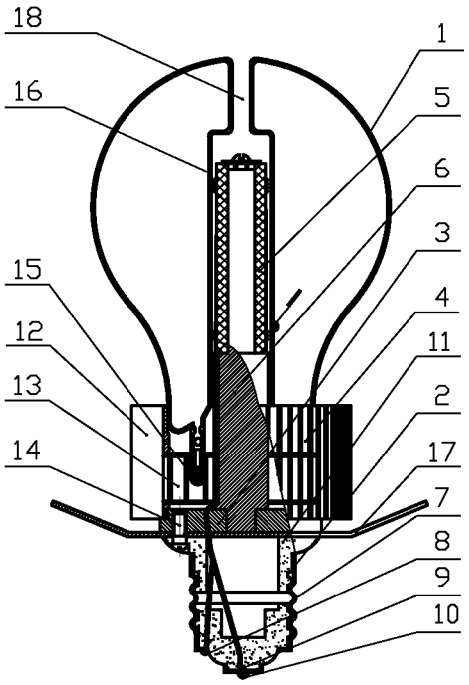
FIG. 6 shows a structure diagram of an Embodiment 5 of the disclosure.

FIG. 6 shows an Embodiment 5 of a self-cooling screw bulb-type electromagnetic induction lamp of the disclosure. In this embodiment, based on the Embodiment 4 and as shown in FIG. 6, a radiating plate 17 as described in the Embodiment 3 is arranged on the lower plane of the heat-conducting piece 3; the heat-conducting piece 3 and the radiating plate 17 are fixed on the screw-type lamp cap 2 through the screw 14. Besides, the ceramic transition piece 11 is arranged between the radiating plate 17 and the screw-type lamp cap 2.

The radiating plate 17 is in a gear shape and each tooth is in a long strip shape (see FIG. 4), so that a relatively long gap is kept between adjacent teeth. Moreover, the radiating plate 17 is in a bent shape and the edge is bent towards the bulb body 1 (see FIG. 6), so as to increase the contact area between the radiating plate 17 and the metal lamp cover.

While the heat of the coupler is conducted to the metal lamp cap cover 4 through the heat-conducting piece 3, the heat is further conducted to the radiating plate 17 and then is taken away in a mode of metal heat-conduction mode through the contact between the radiating plate 17 and the metal lamp cover, thus the heat-radiating effect is obviously improved and the power of the lamp can be made greater.

What is claimed is:

1. A self-cooling screw bulb-type electromagnetic induction lamp, comprising: a bulb body (1), an inner tube (16), amalgam (15) and a coupler, wherein the inner tube (16) is arranged inside the bulb body (1), and the coupler is arranged inside the inner tube (16);

besides, the lamp further comprises a screw-type lamp cap (2) and a radiating piece, wherein the bulb body (1) is connected on the screw-type lamp cap (2) through the radiating piece, and the coupler is connected with the radiating piece, wherein the radiating piece comprises a heat-conducting piece (3), a metal lamp cap cover (4) and more radiating fins (12); the heat-conducting piece (3) is arranged below the metal lamp cap cover (4) and is connected with the coupler; the radiating fins (12) is arranged in order on the outer wall of the metal lamp cap cover (4); and the bulb body (1) is connected on the screw-type lamp cap (2) through the metal lamp cap cover (4) and the heat-conducting piece (3), wherein the amalgam (15) is arranged at the bottom of the bulb body (1) and inside the metal lamp cap cover (4), wherein a radiating window (13) is arranged on the position of the metal lamp cap cover (4) corresponding to the amalgam (15), wherein a through hole (18) interconnected with the inner tube (16) is arranged on the bulb body (1), and the lower end of the inner tube (16) is interconnected with the radiating window (13).

2. The self-cooling screw bulb-type electromagnetic induction lamp according to claim 1, wherein the through hole (18) is located at the top end of the inner tube (16) and the top of the bulb body (1).

3. The self-cooling screw bulb-type electromagnetic induction lamp according to claim 1, further comprising a radiating plate (17) which is connected on the lower plane of the heat-conducting piece (3).

4. The self-cooling screw bulb-type electromagnetic induction lamp according to claim 3, wherein the radiating plate (17) is in a gear shape and each tooth is in a long strip shape.

5. The self-cooling screw bulb-type electromagnetic induction lamp according to claim 4, wherein the radiating plate (17) is in a bent shape and the edge is bent towards the bulb body (1).

6. The self-cooling screw bulb-type electromagnetic induction lamp according to claim 1, wherein the screw-type lamp cap (2) is connected to a power supply of the electromagnetic induction lamp through an electrode lead welding spot (8) on a metal screw-type lamp cap (7) and an electrode lead welding spot (10) on an electrode contact (9).

7. The self-cooling screw bulb-type electromagnetic induction lamp according to claim 1, wherein a ceramic transition piece (11) is arranged between the radiating piece and the screw-type lamp cap (2).

* * * * *